US006990940B2

(12) United States Patent
Sakurai

(10) Patent No.: US 6,990,940 B2
(45) Date of Patent: Jan. 31, 2006

(54) ENGINE STARTING DEVICE AND SADDLE-TYPE TRAVELING VEHICLE

(75) Inventor: Taisuke Sakurai, Shizuoka-ken (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/843,692

(22) Filed: May 11, 2004

(65) Prior Publication Data

US 2004/0237924 A1 Dec. 2, 2004

(30) Foreign Application Priority Data

May 12, 2003 (JP) ..... 2003-132481
Apr. 7, 2004 (JP) ..... 2004-113067

(51) Int. Cl.
*F02M 23/04* (2006.01)

(52) U.S. Cl. ..... 123/179.18

(58) Field of Classification Search ..... 123/179.18
See application file for complete search history.

(56) References Cited

U.S. PATENT DOCUMENTS 5,740,781 A * 4/1998 Scott et al. ..... 123/179.18

FOREIGN PATENT DOCUMENTS

JP 07-044754 Y2 10/1995

* cited by examiner

*Primary Examiner*—Andrew M. Dolinar
(74) *Attorney, Agent, or Firm*—Hogan & Hartson L.L.P.

(57) ABSTRACT

An engine starting device includes an air-intake flow channel in which air sucked by an engine flows. A throttle valve is provided in the air-intake flow channel for controlling airflow. An air channel bypassing the throttle valve and communicating the air-intake flow channel between an upstream side and a downstream side of the throttle valve is also provided. The air channel includes a first channel portion and a second channel portion. A first opening-closing valve opens and closes the first channel portion of the air channel and a control device controls the first opening-closing valve. The engine starting device also includes a second opening-closing valve opening and closing the second channel portion and the first channel portion. The control device determines a starting state of the engine, controls the first opening-closing valve to open the first channel portion when the engine is not in the starting state and to close the first channel portion after the engine has started. The second opening-closing valve is adapted to be switched between a first state in which the second channel portion is opened and the first channel portion is closed and a second state in which the first channel portion is opened and the second channel portion is closed.

20 Claims, 4 Drawing Sheets

ENGINE STARTING DEVICE AND SADDLE-TYPE TRAVELING VEHICLE

BACKGROUND OF THE INVENTION

1. Field of the Invention

The present invention relates to an engine starting device provided with a hot starting mechanism and a saddle-type traveling vehicle provided with the engine starting device.

2. Description of Related Art

A conventional engine starting device includes an intake pipe for introducing an air-fuel mixture to an engine, an auxiliary-air introducing channel for introducing auxiliary-air to the intake pipe, and an auxiliary-air control valve for varying the amount of auxiliary-air introduced to the intake pipe. The engine starting device is adapted to control the air-fuel ratio of the air-fuel mixture introduced into the engine by varying the amount of auxiliary-air introduced. Accordingly, the air-fuel ratio at the time of a hot start in a fuel injection internal combustion engine is controlled.

The conventional engine starting device is adapted in such a manner that the auxiliary-air introducing channel is closed when the engine stops and the auxiliary-air introducing channel is opened when the engine rotates. Hence, there arises a problem that the engine in a warmed state cannot be restarted quickly since the auxiliary-air introducing channel is in a closed state when the engine is stopped during travel.

When the starting device does not have a battery, electric power cannot be supplied to a control circuit for controlling the auxiliary-air control valve until a stable rotation of the engine at a predetermined rotary speed is achieved. For example, in the case of a motorcycle for off-road racing, the motorcycle does not have a battery, but is provided with a kick-start mechanism. Therefore, the auxiliary-air introducing channel cannot be opened when restarting the engine, and hence a problem arises in that the engine cannot be restarted even when the engine is warm.

In the motorcycle having the starting device of this type, the auxiliary-air introducing channel which can be opened and closed manually is provided, and hence the opening and closing operation of the auxiliary-air introducing channel has to be done manually when the engine has stopped. Therefore, when the engine stops during racing, it is difficult to quickly restart the engine. In addition, since the opening and closing operation of the auxiliary-air introducing channel has to be done manually, a problem occurs that the operator forgets to close the auxiliary-air introducing channel after restarting and hence the air-fuel mixture of a low concentration is supplied to the engine after restarting as well, which impairs sufficient demonstration of the engine performance.

Accordingly, it is an advantage of the present invention to provide an engine starting device and a motorcycle in which an engine can be restarted quickly and reliably when restarting the engine which has stopped during travel, irrespective of the present or the absence of a battery. This advantage is achieved by a combination of characteristics stated in the independent claims. Dependent claims define further advantageous embodiments of the present invention.

SUMMARY OF THE INVENTION

In order to achieve the above-described advantage, a first embodiment of the present invention includes a flow channel in which air sucked by an engine flows. A throttle valve is provided in the flow channel for controlling airflow. An air channel bypassing the throttle valve and communicating the upstream side and the downstream side of the throttle valve is also provided. A first opening-closing valve is capable of opening and closing a first channel portion of the air channel and a control device is provided for controlling the first opening-closing valve, a second channel portion of the air channel, which is different from the first channel portion, and a second opening-closing valve capable of opening and closing the first channel portion and the second channel portion. The first opening-closing valve is controlled by the control device to open the first channel portion when the engine stops and closes the first channel portion after the engine has started. The second opening-closing valve is adapted to be switched between a state in which the second channel portion is opened and the first channel portion is closed and a state in which the first channel portion is opened and the second channel portion is closed.

Accordingly, since a cold start air channel, which is an example of the second channel portion, and a hot start air channel, which is an example of the first channel portion, can be switched for use when the engine stops, the engine can be started reliably depending on the state of the engine, either the cold state or the warmed state. The control device controls the opening-closing means to open the channel constantly when the engine is stopped.

Preferably, the control device is adapted to control the first opening-closing valve constantly to open the first channel when the engine is stopped. The control unit preferably includes an urging unit that urges the first opening-closing valve in the direction to open the first channel portion and an actuator for closing the first channel portion against an urging force of the urging unit by driving the first opening-closing valve in the closing direction when electric power is supplied. The actuator includes a hydraulic type, an electric type, and a negative pressure responsive type, and may be other types.

For example, the control device includes a solenoid, a valve for closing the hot start air channel in the case where electric power is supplied to the solenoid, and a resilient device for pressing the valve so as to open the hot start air channel when no electric power is supplied to the solenoid. In this case, the resilient device is preferably adapted to generate an urging force in the direction to bring the hot start air channel into the opened state.

Accordingly, the electric power to open the hot start air channel when the engine is stopped is not necessary. For example, when the starting device is not provided with a battery, the engine can be restarted immediately after having been stopped.

Preferably, the starting device further includes a battery for supplying electric power to the control device, and a switch for selecting whether or not to supply electric power from the battery to the control device, and is adapted to control the first opening-closing valve by turning the switch ON to open the first channel portion. Accordingly, the hot start air channel can be opened only when starting the engine with the minimum power supply required. Power consumption can be reduced in comparison with the type in which the electric power is constantly supplied when the engine is stopped.

Preferably, the control device is adapted to control the first opening-closing valve to close the first channel portion when a rotary speed of the engine falls within a stable range. The control device is preferably adapted to control the first opening-closing valve to close the first channel portion when a predetermined period has elapsed after the engine has started. Accordingly, the air-fuel mixture at a suitable concentration can be supplied to the engine both when starting the engine and when traveling.

According to a second embodiment of the present invention, a saddle-type traveling vehicle provided with the above-described engine starting device is provided. The saddle-type traveling vehicle includes vehicles for traveling off road such as an off-road motorcycle or a four-wheel buggy.

DETAILED DESCRIPTION OF THE PREFERRED EMBODIMENTS

Figure 1:
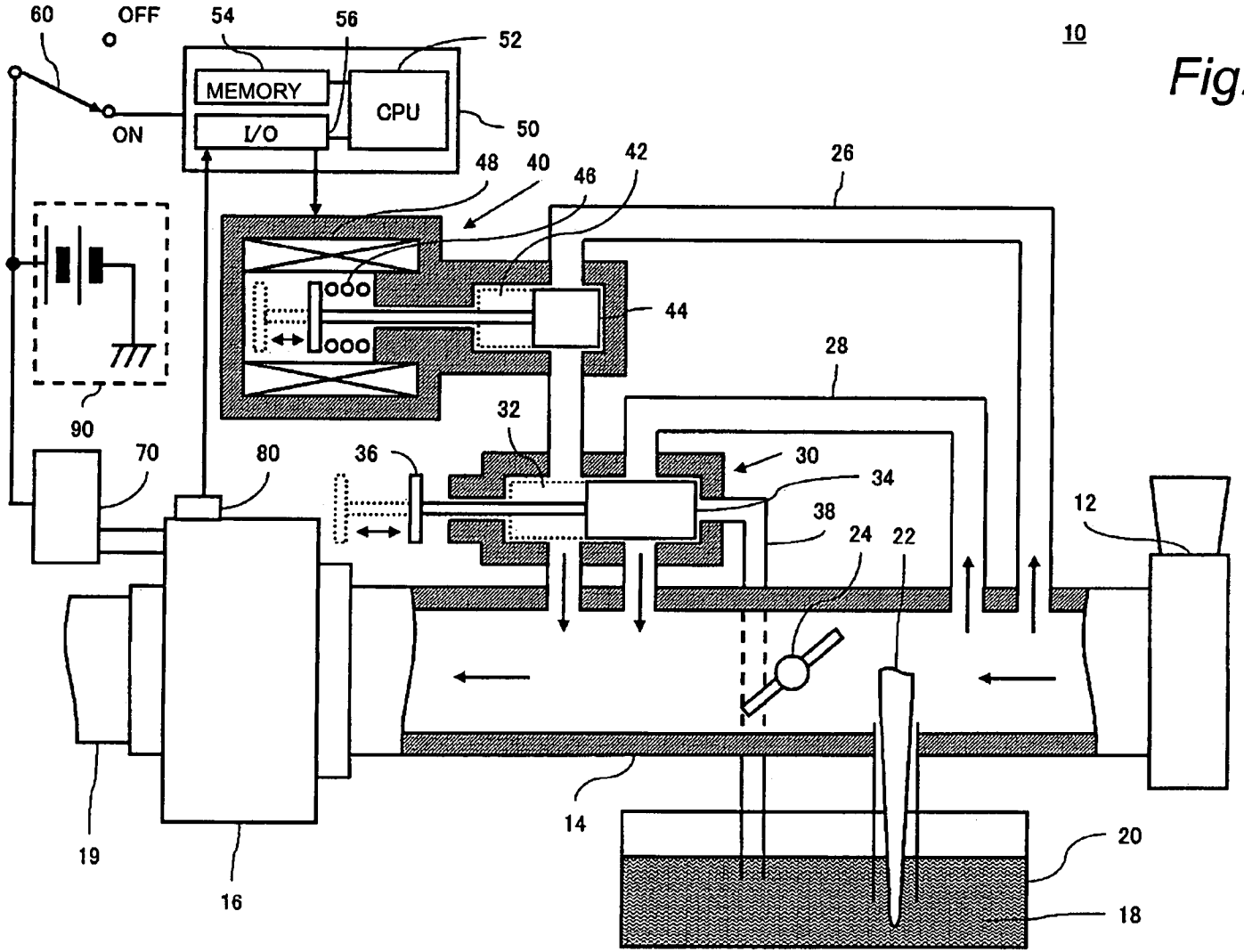
FIG. 1 is a drawing showing an internal combustion engine 10 according to an embodiment of the present invention.

Referring now to the drawings, the present invention will be described via embodiments of the invention. However, the following embodiments are not intended to limit the invention relating the appended claims, and all the combinations of characteristics described in the embodiments are not necessarily essential for means for achieving the invention.

Figure 4:
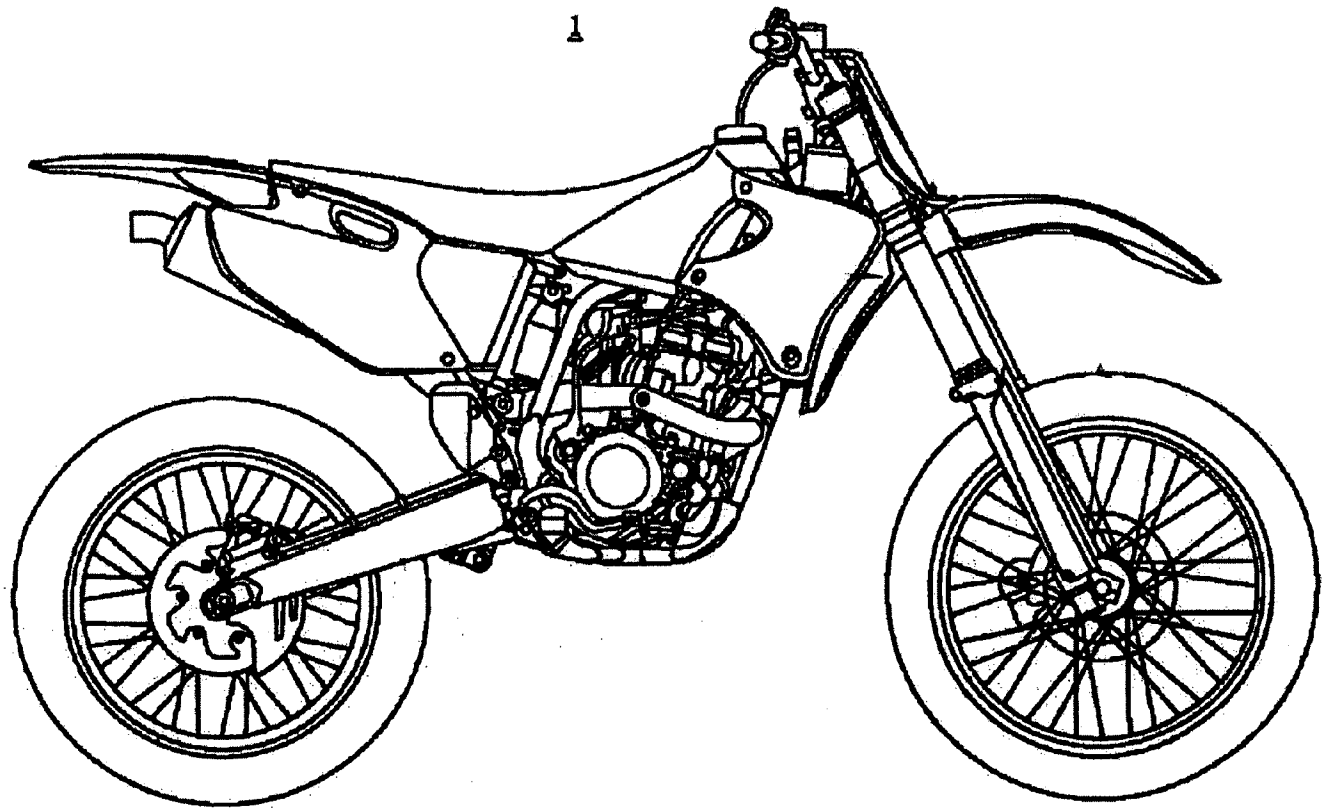
FIG. 4 is a drawing showing an exemplary saddle-type traveling vehicle in which the engine starting device of the present invention may be embodied.

FIG. 1 is a drawing showing an internal combustion engine 10 according to an embodiment of the present invention. The internal combustion engine 10 includes an air intake mechanism 12 for taking air from the outside, a flow channel 14 in which air and an air-fuel mixture flow, an engine 16, an exhaust channel 19 for exhausting combustion gas from the engine 16, a float chamber 20 in which fuel 18 is stored, a needle valve 22 for adjusting the amount of fuel 18 supplied to the flow channel 14, a throttle valve 24 for adjusting the flow of the air-fuel mixture in the flow channel 14, a cold starting mechanism 30, a hot starting mechanism 40, and a control unit 50 for controlling the hot starting mechanism 40. Engine 10 and its associated elements may be embodied in a saddle-type traveling vehicle such as saddle-type traveling vehicle 1 of FIG. 4.

In the flow channel 14, a hot start air channel 26 as an example of a first channel portion and a cold start air channel 28 as an example of a second channel portion for adjusting the concentration of the air-fuel mixture flowing in the flow channel 14 are connected. The hot start air channel 26 is connected at one end thereof to the flow channel 14 upstream of the throttle valve 24, and at the other end downstream of the throttle valve 24. The flow rate and/or the concentration of the air-fuel mixture flowing in the flow channel 14 is adjusted by supplying air flown from one end into the flow channel 14 via the other end. The hot start air channel 26 is adapted to supply air to the flow channel 14 via the hot starting mechanism 40 and the cold starting mechanism 30 provided between one end and the other end. The hot start air channel 26 and the cold start air channel 28 may be disposed adjacent to each other. For example, the hot start air channel 26 and the cold start air channel 28 may share part of members constituting them.

Although the hot start air channel 26 as an example of the first channel portion and the cold start air channel 28 as an example of the second channel portion are provided separately in the present embodiment, they may be provided integrally as a single unit. For example, the hot start air channel 26 and the cold start air channel 28 may be formed by providing a partition in a single air channel and dividing the area of the air channel. In other words, a configuration in which a partition is provided at a boundary between the hot start air channel 26 and the cold start air channel 28 in the single air channel is also applicable.

The cold start air channel 28 is connected at one end to the flow channel 14 upstream of the throttle valve 24, and at the other end downstream of the throttle valve 24. The cold start air channel 28 is adapted to be capable of adjusting the flow rate and/or the concentration of the air-fuel mixture flowing in the flow channel 14 by supplying the air-fuel mixture obtained by mixing air flown from one end and fuel 18 supplied from a fuel supply channel 38 between one end and the other end into the flow channel 14 through the other end.

The cold starting mechanism 30 is adapted to be capable of opening and closing the cold start air channel 28 and the fuel supply channel 38. In the cold starting mechanism 30, the air-fuel mixture is generated in a space 32, which is formed in the cold starting mechanism 30 when the cold start air channel 28 is opened, by mixing air supplied from the cold start air channel 28 and fuel 18 supplied from the fuel supply channel 38 connected to the cold starting mechanism 30.

The cold starting mechanism 30 is adapted to be capable of opening and closing the hot start air channel 26. In other words, the cold starting mechanism 30 is adapted to be capable of opening and closing the hot start air channel 26 and the cold start air channel 28, so as to open the cold start air channel 28 when the hot start air channel 26 is closed and open the hot start air channel 26 when the cold start air channel 28 is closed.

More specifically, the cold starting mechanism 30 is inserted into the space 32, and includes a second opening-closing valve 34 slidably provided in the space 32. When the hot start air channel 26 is closed by advancing or retracting the second opening-closing valve 34 in the space 32 by a valve control unit 36, the cold start air channel 28 is opened and the fuel supply channel 38 connected to the cold starting mechanism 30 is opened. On the other hand, when the hot start air channel 26 is opened by advancing or retracting the second opening-closing valve 34 in the space 32 by the valve control unit 36, the cold start air channel 28 is closed and the fuel supply channel 38 is closed (See dotted line in the drawing). As described later, while the hot starting mechanism 40 has a solenoid 48, the valve control unit 36 of the cold starting mechanism 30 is operated manually. Since the cold starting mechanism 30 is operated when prompt reaction is not required such as during warming up before a race, it does not matter if it is a manual operation.

The hot starting mechanism 40 is adapted to be capable of opening and closing the hot start air channel 26. More specifically, the hot starting mechanism 40 is inserted into a space 42 defined inside the hot starting mechanism 40, and has a first opening-closing valve 44 slidably provided in the space 42. As an example of the control unit for controlling the first opening-closing valve 44, a coil spring 46 and the solenoid 48 for advancing and retracting the first opening-closing valve 44 in the space 42, and the control unit 50 for controlling the solenoid 48 are provided.

The coil spring 46 is provided so as to urge the first opening-closing valve 44 in the direction to open the hot start air channel 26. The solenoid 48 is constructed in such a manner that the first opening-closing valve 44 closes the hot start air channel 26 when an electric current is supplied from the control unit 50. In other words, when the electric current is not supplied to the solenoid 48, the first opening-closing valve 44 moves by a resiliency of the coil spring 46, and hence the hot start air channel 26 is opened, while when the electric current is supplied to the solenoid 48, the first opening-closing valve 44 moves by a magnetic field generated by the solenoid 48, and hence the hot start air channel 26 is closed (See dotted line in the drawing).

The control unit 50 includes a CPU 52, a memory 54, and an I/O unit 56. The I/O unit 56 receives data on rotary speed of the engine detected by an engine speed detecting unit 80, and supplies the data on rotary speed of the engine to the CPU 52. The memory 54 stores a table in which the rotary speed and the rotating time of the engine 16 coordinated with the amount of electric current to be supplied to the solenoid 48, and the CPU 52 references the table, and determines the amount of the electric current to be supplied to the solenoid 48 based on the data on the rotary speed of the engine and the rotating time of the engine 16. The I/O unit 56 supplies the amount of electric current specified by the CPU 52 to the solenoid 48.

The control unit 50 may control the hot starting mechanism 40 based on whether or not the electric power is supplied. For example, the control unit 50 may be adapted to control the solenoid 48 in such a manner that the hot start air channel 26 is closed when electric power is supplied from a generator 70, which converts the power of the engine 16 to electric power. When the internal combustion engine 10 is further provided with a battery 90 for supplying the power to the control unit 50, the control unit 50 may be adapted to control the solenoid 48 to close the hot start air channel 26 when the electric power is supplied from the battery 90 by turning a power switch 60 ON prior to the starting operation of the engine 16.

Figure 2:
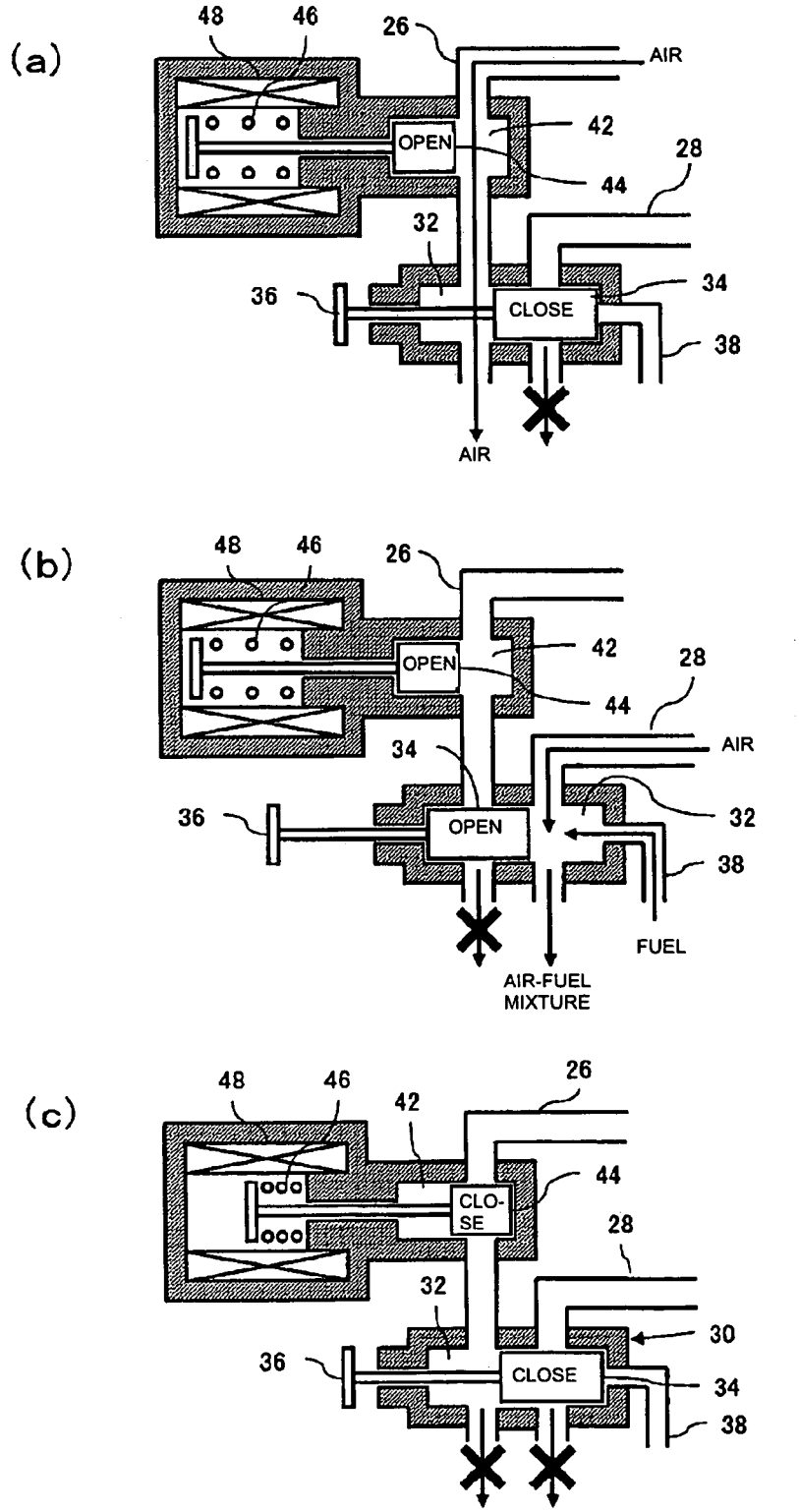
FIGS. 2(*a*)–2(*c*) show the operation of a cold starting mechanism 30 and a hot starting mechanism 40.

FIG. 2 is a drawing showing states of the cold starting mechanism 30 and the hot starting mechanism 40 according to the different operating states of the engine 16. Referring to FIG. 1 and FIG. 2, the operation of the cold starting mechanism 30 and the hot starting mechanism 40 for adjusting the flow rate and/or the concentration of the air-fuel mixture flowing in the flow channel 14 will be described in the following respective states; before starting engine 16, traveling after having started the engine, and being stopped after having started the engine; and in a case in which the internal combustion engine 10 is not provided with a battery 90 (See FIG. 1).

FIG. 2(*a*) is a drawing showing a state of the cold starting mechanism 30 and the hot starting mechanism 40 before starting the engine 16. Before starting the engine 16, the cold start air channel 28 is closed and the hot start air channel 26 is opened. In the cold starting mechanism 30, the second opening-closing valve 34 takes the closed position to close the cold start air channel, and the fuel supply channel 38 is closed as the cold start air channel 28 is closed. Therefore, no air-fuel mixture is supplied from the cold start air channel 28 to the flow channel 14.

In the cold starting mechanism 30, when the second opening-closing valve 34 takes the closed position, the hot start air channel 26 is opened in the cold starting mechanism 30. On the other hand, in this example, since the internal combustion engine 10 is not provided with the battery 90 and hence the electric power is not supplied to the solenoid 48 from the control unit 50 before starting the engine 16, the first opening-closing valve 44 takes the opened position to open the hot start air channel 26 by being pressed by the coil spring 46. Therefore, before starting the engine 16, the cold start air channel 28 is closed, and the hot start air channel 26 is opened. Therefore, air can be supplied to the flow channel 14 from the hot start air channel 26.

FIG. 2(*b*) is a drawing showing a state in which the cold starting mechanism 30 and the hot starting mechanism 40 are at the time of starting the engine 16 in the cold state. When the engine 16 is in the cold state, the second opening-closing valve 34 is moved by the valve control unit 36 so that the second opening-closing valve 34 takes the opened position to allow the air-fuel mixture of a high concentration to be supplied to the engine 16. Since both of the cold start air channel 28 and the fuel supply channel 38 are opened when the second opening-closing valve 34 takes the opened position, air and fuel 18 can be supplied to the cold starting mechanism 30 from the cold start air channel 28 and the fuel supply channel 38.

On the other hand, when the second opening-closing valve 34 takes the opened position in the cold starting mechanism 30, the hot start air channel 26 in the cold starting mechanism 30 is closed. Accordingly, air is not supplied from the hot start air channel 26 to the flow channel 14.

Then, when the engine 16 is started in a state in which the cold start air channel 28 is opened and the hot start air channel 26 is closed as described above, air and fuel 18 are supplied from the cold start air channel 28 and the fuel supply channel 38 to the cold starting mechanism 30, and consequently, the air-fuel mixture is supplied to the flow channel 14. Accordingly, since air-fuel mixture of a high concentration is supplied to the engine 16, the engine 16 in the cold state can easily be started.

FIG. 2(*c*) is a drawing showing the state of the cold starting mechanism 30 and the hot starting mechanism 40 during travel after the engine 16 has started. After the engine 16 has started, it is not necessary to supply air-fuel mixture of a high concentrate to the engine 16 any longer. As such, the second opening-closing valve 34 is moved to the closed state by the valve control unit 36. Accordingly, the cold start air channel 28 is closed and the fuel supply channel 38 is also closed, and hence no air-fuel mixture is supplied from the cold start air channel 28 to the flow channel 14 during travel.

When the second opening-closing valve 34 takes the closed position in the cold starting mechanism 30, the hot start air channel 26 is opened in the cold starting mechanism 30. On the other hand, electric power is supplied from the generator 70 to the control unit 50 during travel and the rotary speed of the engine 16 detected by the engine speed detecting unit 80 is supplied to the control unit 50. Then, based on the rotary speed, since an electric current is supplied from the control unit 50 to the solenoid 48, the first opening-closing valve 44 takes the closed position to close the hot start air channel 26 in the hot starting mechanism 40, and hence the hot start air channel 26 is closed. Therefore, air or the air-fuel mixture is supplied to the flow channel 14 neither from the cold start air channel 28 nor the hot start air channel 26, and hence the air-fuel mixture of a concentration suitable for traveling, which is generated in the flow channel 14, is supplied to the engine 16.

Figure 3:
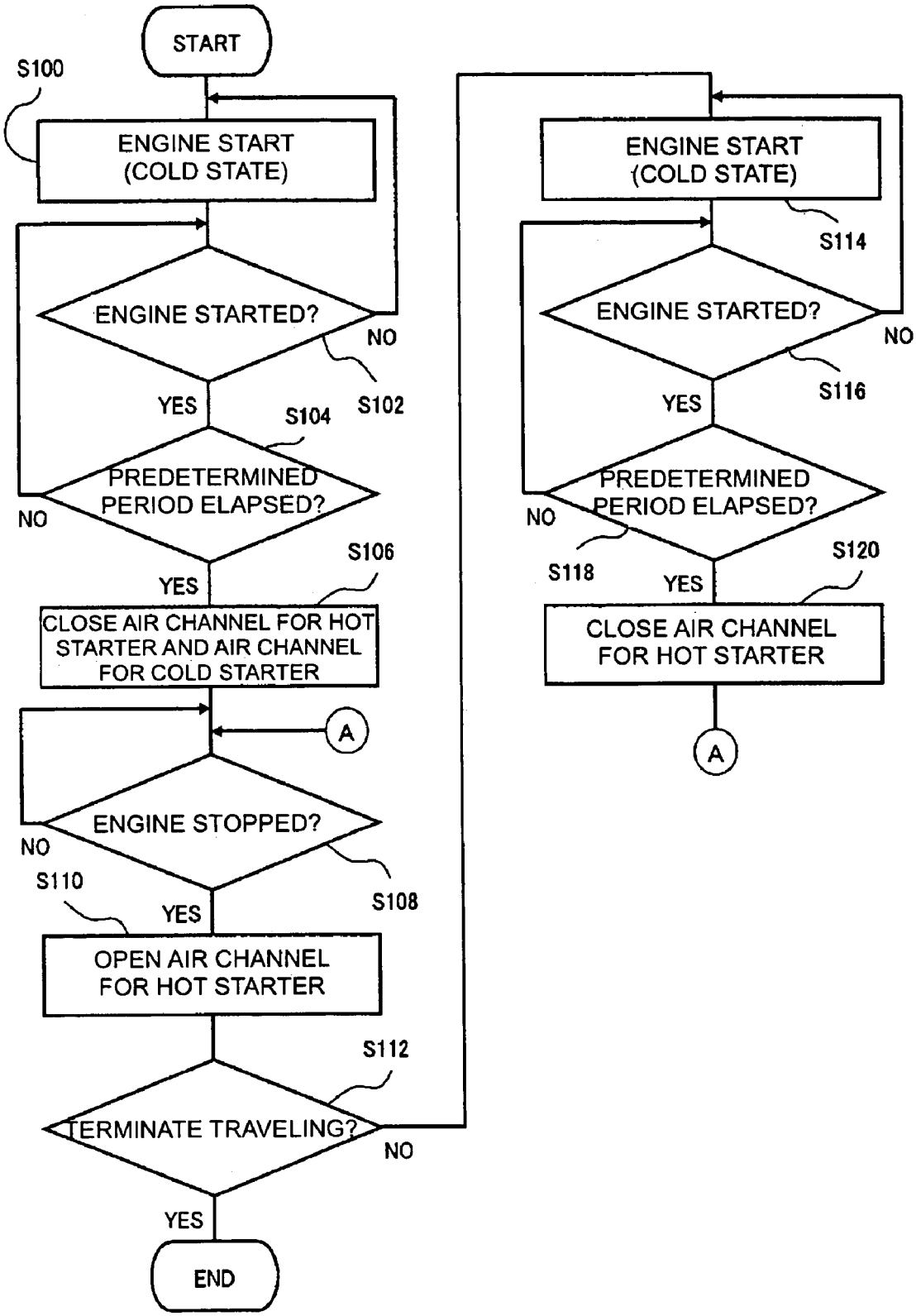
FIG. 3 is a flow chart showing an example of the operation of the internal combustion engine 10 according to the present embodiment.

FIG. 3 is a flow chart showing an example of the operation of the internal combustion engine 10 according to an embodiment of the present embodiment. Referring now to FIG. 1 to FIG. 3, the operation of the internal combustion engine 10 will be described below.

First, the engine 16 in the cold state is started (S100). At this time, the second opening-closing valve 34 takes the opened position for supplying the air-fuel mixture from the cold start air channel 28 to the flow channel 14 in the cold starting mechanism 30. Since the engine 16 has not rotated before starting the engine 16, an electric current has not been supplied to the solenoid 48, and the first opening-closing valve 44 takes the opened position in the hot starting mechanism 40 (FIG. 2(*b*)). In this state, the engine is started by the engine starting device such as a kick starter (not shown). When the engine 16 has already warmed up after the engine 16 starts, the operation begins from step (S114) for restarting the engine 16, which will be described later.

When the engine 16 has not been started (No in S102), the engine is started again (S100). When the engine speed detecting unit 80 detects that the engine 16 is rotating at a predetermined rotary speed (YES in S102), and a predetermined period has elapsed at a state in which the engine 16 is rotating at the rotary speed (YES in S104), the control unit 50 determines that the rotary speed of the engine falls to a stable range. At this time, the predetermined time may be set to zero by the control unit 50 to determine the state in which the engine rotates at the predetermined rotary speed as the state in which the rotary speed of the engine falls to the stable range.

The control unit 50 closes the hot start air cannel 26 by supplying a predetermined electric current to the solenoid 48 when it is determined that the rotary speed of the engine falls within the stable range (S106). Since the rotary speed of the engine falls within the stable range, the cold start air channel 28 is also closed (S106 FIG. 2(*a*)). Then, after the engine has been started, in the normal traveling state, the cold start air channel 28 and the hot start air channel 26 are both closed (FIG. 2(*a*)). Then, the control unit 50 holds the cold starting mechanism 30 and the hot starting mechanism 40 in the above-described state unless the engine 16 is stopped (NO in S108).

On the other hand, when the rotary speed of the engine is detected to be zero by the engine speed detecting unit 80, and hence it is determined that the engine 16 has stopped (YES in S108), the control unit 50 opens the hot start air channel 26 (S110 FIG. 2(*c*)). When traveling again (NO in S112), the engine 16 is restarted by the engine starting device such as the kick starter (not shown) (S114). In this case, since the engine 16 is in the warmed state, the second opening-closing valve 34 in the cold starting mechanism 30 is brought into the closed state to close the cold start air channel 28, and starts the engine 16 in the state in which the hot start air channel 26 is opened (FIG. 2(*c*)).

When the engine 16 has not been started (NO in S116), the engine 16 is restarted (S114). When the engine 16 has been started (YES in S116), the engine speed detecting unit 80 detects that the engine 16 is rotating at a predetermined rotary speed (YES in S116), and when a predetermined time period has elapsed at a state in which the engine 16 is rotated at the predetermined rotary speed (YES in S118), the control unit 50 determines that the engine speed falls within the stable range. Then, when it is determined that the rotary speed of the engine falls within the stable range, the control unit 50 closes the hot start air channel 26 by supplying a predetermined electric current to the solenoid 48 (S120). Then, the control unit 50 holds the cold starting mechanism 30 and the hot starting mechanism 40 in the above-described state unless the engine 16 is stopped (NO in S108).

According to the present embodiment, since both of the cold start air channel 28 and the hot start air channel 26 are never opened, the air-fuel mixture of a high concentration can be supplied reliably from the flow channel 14 to the engine 16 when the engine 16 is in the cold state. In addition, since the operator does not need to operate both of the cold starting mechanism 30 and the hot starting mechanism 40, erroneous opening operations of the cold start air channel 28 and the hot start air channel 26 are reduced. When the engine 16 is in the warmed state, the engine 16 can be restarted without detecting the temperature of the engine 16.

According to the present embodiment, by configuring the hot start air channel 26 to be opened in a state in which the engine 16 has stopped, the engine 16 can immediately be restarted when the engine 16 has stopped. Also, by configuring the hot start air channel 26 to be opened and closed based on the rotary speed of the engine 16 or the time elapsed after having started the engine 16, the air-fuel mixture at a suitable concentration can be supplied to the engine 16 both when starting the engine 16 and when traveling.

The examples or the applications described through the embodiments of the invention may be combined, modified, or improved as needed according to its usage, and the present invention is not limited to the above-described embodiment. The mode combined, modified, or improved as such is also included in the technical scope of the invention, as is clear from the claims.

What is claimed is:

1. An engine starting device, comprising:

an air-intake flow channel in which air sucked by an engine flows;

a throttle valve provided in the air-intake flow channel for controlling airflow;

an air channel bypassing the throttle valve and communicating the air-intake flow channel between an upstream side and a downstream side of the throttle valve, the air channel having a first channel portion and a second channel portion;

a first opening-closing valve opening and closing the first channel portion of the air channel;

a control device for controlling the first opening-closing valve; and a second opening-closing valve opening and closing the second channel portion and the first channel portion, wherein the control device determines a starting state of the engine, controls the first opening-closing valve to open the first channel portion when the engine is not in the starting state and to close the first channel portion after the engine has started, and wherein the second opening-closing valve is adapted to be switched between a first state in which the second channel portion is opened and the first channel portion is closed and a second state in which the first channel portion is opened and the second channel portion is closed.

2. The engine starting device according to claim 1, wherein the control device is adapted to control the first opening-closing valve to open the first channel portion when the engine is stopped.

3. The engine starting device according to claim 2, wherein the control device comprises a means for urging the first opening-closing valve in a direction to open the first channel portion and an actuator for closing the first channel portion against an urging force of the means for urging by driving the first opening-closing valve in a closing direction when electric power is supplied.

4. The engine starting device according to claim 1, further comprising a battery that supplies electric power to the control device and a switch that selects whether or not to supply the electric power from the battery to the control device and adapted to control the first opening-closing valve by turning the switch to an ON state to open the first channel portion.

5. The engine starting device according to claim 1, wherein the control device is adapted to control the first opening-closing valve to close the first channel portion when a rotary speed of the engine falls within a stable range.

6. The engine starting device according to claim 1, wherein the control device is adapted to control the first opening-closing valve to close the first channel portion when a predetermined period has elapsed after the engine has started.

7. A saddle-type traveling vehicle comprising the engine starting device according to claim 1.

8. The engine starting device according to claim 1, further comprising an air-intake mechanism for providing the sucked air.

9. The engine starting device according to claim 1, further comprising an exhaust channel for exhausting combination gas.

10. The engine starting device according to claim 1, further comprising a float chamber to store fuel.

11. The engine starting device according to claim 10, further comprising a needle valve to adjust an amount of fuel.

12. The engine starting device according to claim 1, wherein the first channel portion is a cold start air channel.

13. The engine starting device according to claim 1, wherein the second channel portion is a hot start air channel.

14. An engine starting device, comprising:

an air-intake flow channel in which air sucked by an engine flows;

a throttle valve provided in the air-intake flow channel for controlling airflow;

an air channel bypassing the throttle valve and communicating the air-intake flow channel between an upstream side and a downstream side of the throttle valve, the air channel having a first channel portion and a second channel portion;

a first opening-closing valve opening and closing the first channel portion of the air channel;

means for controlling the first opening-closing valve; and a second opening-closing valve opening and closing the second channel portion and the first channel portion, wherein the means for controlling determines a starting state of the engine, controls the first opening-closing valve to open the first channel portion when the engine is not in the starting state and to close the first channel portion after the engine has started, and the second opening-closing valve is adapted to be switched between a first state in which the second channel portion is opened and the first channel portion is closed and a second state in which the first channel portion is opened and the second channel portion is closed.

15. The engine starting device according to claim 14, wherein the means for controlling is adapted to control the first opening-closing valve to open the first channel when the engine is stopped.

16. The engine starting device according to claim 15, wherein the means for controlling comprises a means for urging the first opening-closing valve in a direction to open the first channel portion and an actuator for closing the first channel portion against an urging force of the means for urging by driving the first opening-closing valve in a closing direction when electric power is supplied.

17. The engine starting device according to claim 14, further comprising a battery that supplies electric power to the means for controlling and a switch that selects whether or not to supply the electric power from the battery to the means for controlling and adapted to control the first opening-closing valve by turning the switch to an ON state to open the first channel portion.

18. The engine starting device according to claim 14, wherein the means for controlling is adapted to control the first opening-closing valve to close the first channel portion when a rotary speed of the engine falls within a stable range.

19. The engine starting device according to claim 14, wherein the means for controlling is adapted to control the first opening-closing valve to close the first channel portion when a predetermined period has elapsed after the engine has started.

20. A method for starting an engine, comprising:

providing air to an air-intake flow channel;

controlling airflow in the air-intake flow channel;

bypassing a throttle valve and communicating the air-intake flow channel between an upstream side and a downstream side of the throttle valve;

opening and closing a first channel portion with a first opening-closing valve;

controlling the first opening-closing valve;

opening and closing a second channel portion and the first channel portion with a second opening-closing valve;

determining a starting state of an engine;

controlling the first opening-closing valve to open the first channel portion when the engine is not in the starting state and to close the first channel portion after the engine has started; and switching between a first state in which the second channel portion is opened and the first channel portion is closed and a second state in which the first channel portion is opened and the second channel portion is closed.

* * * * *